US007121444B2

(12) United States Patent
Joyce

(10) Patent No.: US 7,121,444 B2
(45) Date of Patent: Oct. 17, 2006

(54) SPRING ACTUATED STAPLER

(76) Inventor: Michael P. Joyce, 801 W. Shore Dr., Kinnelon, NJ (US) 07405

( * ) Notice: Subject to any disclaimer, the term of this patent is extended or adjusted under 35 U.S.C. 154(b) by 0 days.

(21) Appl. No.: 10/898,019

(22) Filed: Jul. 23, 2004

(65) Prior Publication Data

US 2006/0016846 A1 Jan. 26, 2006

(51) Int. Cl.
*B25C 5/06* (2006.01)

(52) U.S. Cl. ..... 227/132; 227/134

(58) Field of Classification Search ..... 227/120, 227/132, 134

See application file for complete search history.

(56) References Cited

U.S. PATENT DOCUMENTS

| | | | |
|---|---|---|---|
| 3,593,904 | A | 7/1971 | Gaya |
| 3,630,428 | A | 12/1971 | Olney |
| 3,958,738 | A | 5/1976 | Tremblay |
| 4,182,474 | A | 1/1980 | Sato |
| 4,288,019 | A | 9/1981 | Dahle |
| 4,399,938 | A | 8/1983 | Biddle |
| 4,452,388 | A | 6/1984 | Fealey |
| 4,463,890 | A | 8/1984 | Ruskin |
| 5,165,587 | A | 11/1992 | Marks |
| 5,335,838 | A | 8/1994 | Harris et al. |
| 5,356,063 | A | 10/1994 | Perez |
| 5,407,118 | A | 4/1995 | Marks |
| 5,497,932 | A | 3/1996 | Brewer et al. |
| 5,511,716 | A | 4/1996 | Marks |
| 5,664,722 | A | 9/1997 | Marks |
| 5,699,949 | A | 12/1997 | Marks |
| 5,816,470 | A | 10/1998 | Plato et al. |
| 5,979,736 | A | 11/1999 | Edehot |
| 5,988,478 | A | 11/1999 | Marks |
| 6,145,728 | A | 11/2000 | Marks |
| 6,789,719 | B1 | 9/2004 | Shor |
| 6,918,525 | B1 | 7/2005 | Marks |

OTHER PUBLICATIONS

Int'l Search Rept & Written Opinion, Mar. 2, 2006, Joyce.

*Primary Examiner*—Scott A. Smith
(74) *Attorney, Agent, or Firm*—Kaplan Gilman Gibson & Dernier LLP

(57) ABSTRACT

The stapling apparatus of the present invention comprises a base member and a magazine member for accommodating a set of staples, each member having a first end and a second end, and the two members being pivotably connected to each other at the first ends. The stapling apparatus further comprises a striking plate for individually dispensing the staples upon actuation by a striker spring, and a triggering mechanism for triggering the actuation of the striker spring. In particular, the triggering mechanism comprises a triggering lever arranged such that the triggering lever triggers the actuation of the striker spring when the second ends of the two members are moved toward each other.

24 Claims, 12 Drawing Sheets

SPRING ACTUATED STAPLER

FIELD OF THE INVENTION

The present invention relates to a stapling apparatus, and more particularly, to a spring actuated stapler with a simplified triggering mechanism.

BACKGROUND OF THE INVENTION

In a spring-actuated stapler, a striking plate is reciprocally movable between an initial position and a fire position. When the striking plate moves from the initial position to the fire position, an actuation striker spring, which is engaged with a hole on the striking plate, is deformed and energized. When the striking plate reaches the fire position, the striker spring is released to resume its initial shape, in the process driving the striking plate to its initial position to dispense to a work piece a leading staple of a stable stick contained in a staple magazine. A triggering lever is provided to engage with a hole on the striking plate so as to pull the striking plate from the initial position to the fire position when a force is applied on a cover plate during a stapling operation, and then disengages from the hole to release the striking plate to be driven back by the energized striker spring.

In prior systems, a biasing return spring mechanism is also provided to bias the triggering lever back to its initial position in which the triggering lever engages with the hole of the striking plate. Conventionally, the triggering lever is located between the cover plate and the staple magazine (or the body that comprises the magazine), which makes the design of the stapler complicated with more components.

SUMMARY OF THE INVENTION

The present invention is directed to a stapling apparatus with a novel spring actuated mechanism. No cam is needed, as a spring operates as the cam and the power mechanism for the cam.

In one embodiment, a lever running most of the length of the entire stapler is used to load the spring, providing a relatively large loading force with a relatively low amount of user applied pressure, due to the leveraging.

In an exemplary embodiment, the stapling apparatus of the present invention comprises a base member and a magazine member for accommodating a set of staples or a staple stick therein, each member having a first end and a second end, the two members being pivotably connected to each other at the first ends, a striking plate for individually dispensing the staples upon actuation by a striker spring, and a triggering mechanism for triggering the actuation of the striker spring.

More specifically, as taught by the present invention, the triggering mechanism comprises a triggering lever arranged between the base member and the magazine member such that the triggering lever triggers the actuation of the striker spring when the second ends of the two members are moved toward each other. With the triggering lever provided between the base member and the magazine member, the design of the stapler is simplified and utilizes a much smaller number of components.

Preferably, the triggering lever is made of a resilient material, and has a lower end secured to an upper surface of the base member and an upper end freely abutting against an under surface of the staple magazine, whereby normally biasing the second ends of the two members away from each other by a proper distance for accepting a work piece. Thus, the stapler of the present invention may not need an additional raiser element to keep the distance between the base member and the magazine member.

Preferably, the striking spring has a first end to engage with a hole formed on the striking plate for moving the striking plate between a first position and a second position, and the triggering lever engages with the striker spring to force the striker spring to deform during a stapling operation whereby the striker spring brings the striking plate from the first position to the second position. No direct engagement is needed between the triggering lever and the striking plate, thereby simplifying the design of the stapler.

Preferably, a release mechanism is provided to release the engagement between the triggering lever and the striker spring when the striking plate reaches the second position, whereby the striker spring resumes its initial shape and thus powerfully drives the striking plate back to the first position for dispensing a leading one of the staples.

Alternatively, similar to the prior art, the triggering lever may directly engage with the striking plate but not with the striker spring. However, the cover plate in the prior art may be omitted with the teaching of the present invention.

BRIEF DESCRIPTION OF THE DRAWINGS

The above and other features and advantages of the present invention will be clearer by reading the detailed descriptions of the preferred embodiments of the present invention with reference to the accompanying drawings, in which.

DESCRIPTION OF THE PREFERRED EMBODIMENTS OF THE INVENTION

Figure 1:
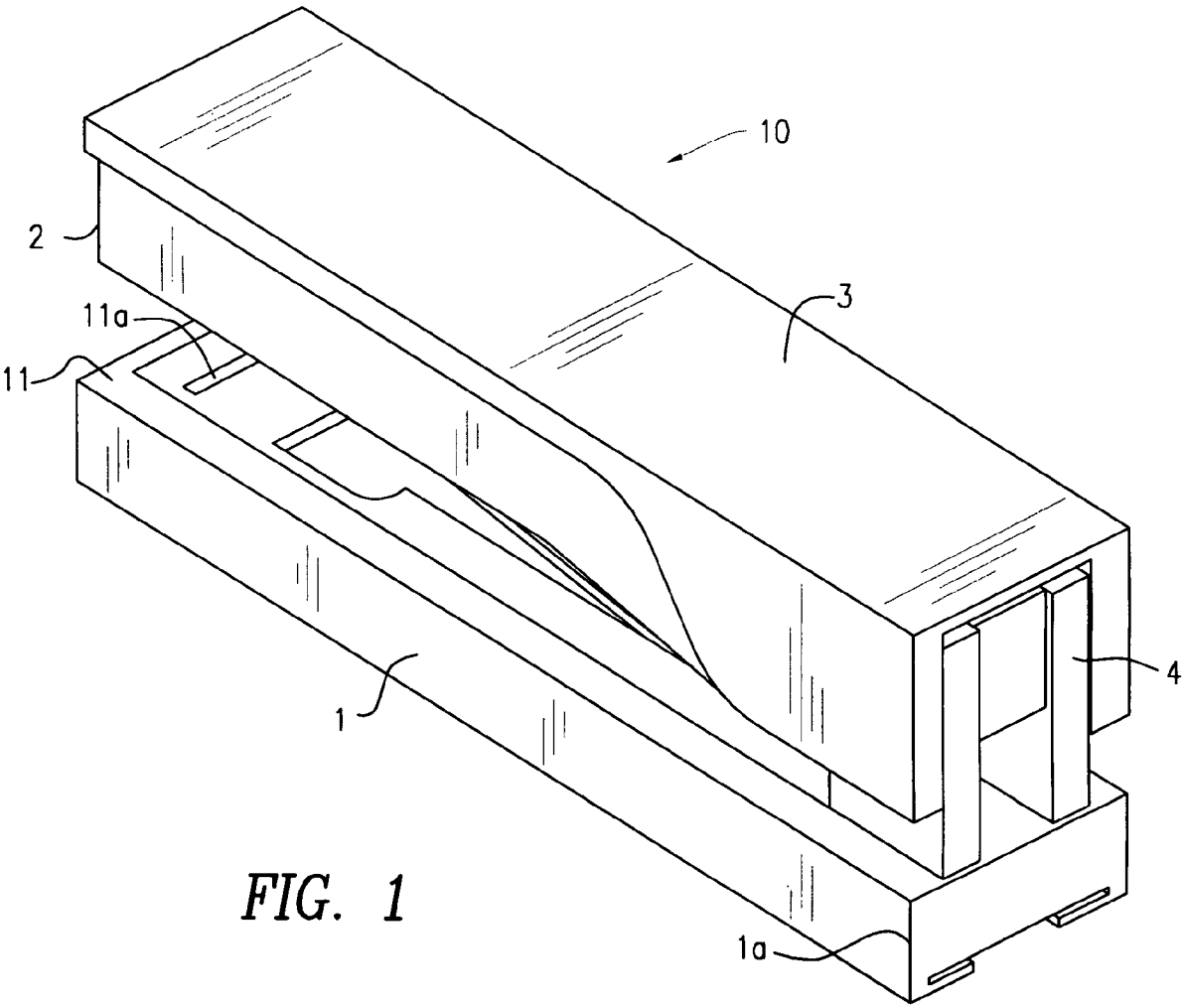
FIG. 1 is a perspective view of the stapler of a first embodiment according to the present invention.

As shown in FIG. 1, the stapler 10 of the first embodiment according to the present invention generally comprises a base 1, a body 2 and a cover plate 3. The body 2, which basically comprises a staple magazine 25 (most clearly in FIGS. 3*a* and 3*b*) for accommodating a set of staples or a staple stick 26, is pivotably connected to a pair of upstanding bracket plates 4 fixedly secured on the upper surface 11 of the base 1 near a rear end 1*a* thereof. Similarly, the cover plate 3 is pivotably connected to the bracket plates 4 too. Proper mechanism (not shown) is also provided to prevent the cover plate 3 and the body 2 from undesirably swinging away from the base 1 without a proper force applied by a user.

Figure 2:
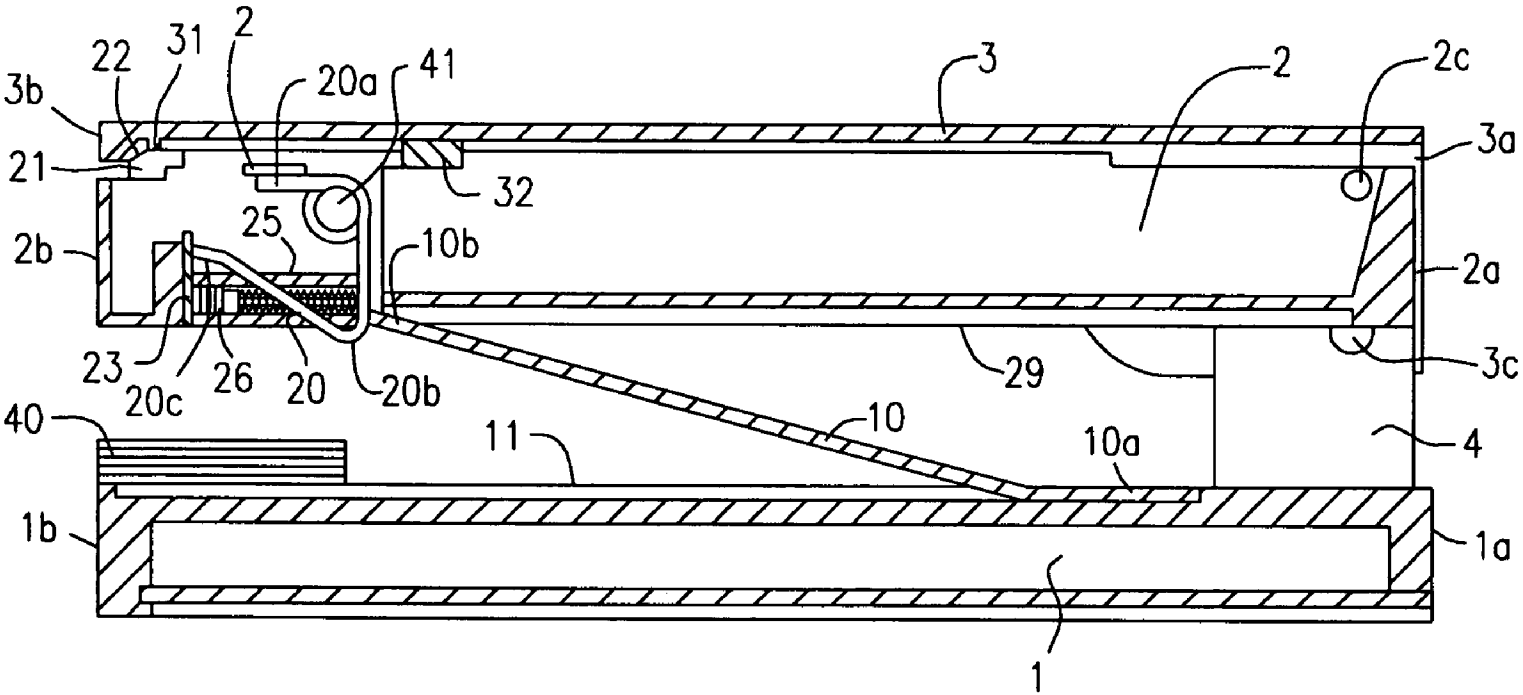
FIG. 2 is a longitudinal sectional view of the stapler shown in FIG. 1.

As shown in FIG. 2, a striking plate 23 is conventionally provided in front of the staple magazine 25 for individually dispensing the staples from the staple stick 26 contained in the staple magazine 25 during a stapling operation. Upon actuation of a striker spring 20 during each stapling operation, the striking plate 23 can reciprocally move vertically between an initial position as shown FIG. 3*a* and a fire position as shown in FIG. 3*b*.

According to an exemplary embodiment of the present invention, a triggering lever 10 is provided between the base 1 and the body 2, and extends forwardly (i.e., in a direction toward the front ends 1*b*, 2*b*) from the upper surface 11 of the base 1 to an under surface 29 of the body 2. The lower end 10*a* is preferably fixed to the upper surface 11 of the base 1, while the upper end 10*b* freely abuts against the under surface 29 of the body 2. Thus, the triggering lever 10 is inclined to slide forward toward the front ends 1*b*, 2*b* of the base 1 and the body along the under surface 29 when front ends 1*b*, 2*b* are forced to move closer to each other.

Preferably, the triggering lever 10 is made of a resilient material, and thus also serves as a raiser element that normally biases the base 1 and the body 2 away from each other by a proper distance, as illustrated in FIG. 2, for accepting a work piece 40, such as a stack of papers, therebetween.

The striker spring 20 is mounted on a lateral shaft 41. An end 20*a* of the striker spring 20 is secured by a stop plate 24 fixed on the body 2, and another end 20*c* of the striker spring 20 engages with a hole formed on the striking plate 23 (more clearly shown in FIGS. 3*a* and 3*b*). The middle or engagement portion 20*b* of the striker spring 20 engages with the upper end 10*b* of the triggering lever 10 when the body 2 and the base 1 are moved closer to each other, whereby the forward movement of the upper end 10*a* of the triggering lever 10 forces the striker spring 20 to deform and rotate clockwise, and the end 20*c* moves upward, bringing the striking plate 23 to move from the initial position to the fire position, as will be explained in more detail below.

Figure 3A:
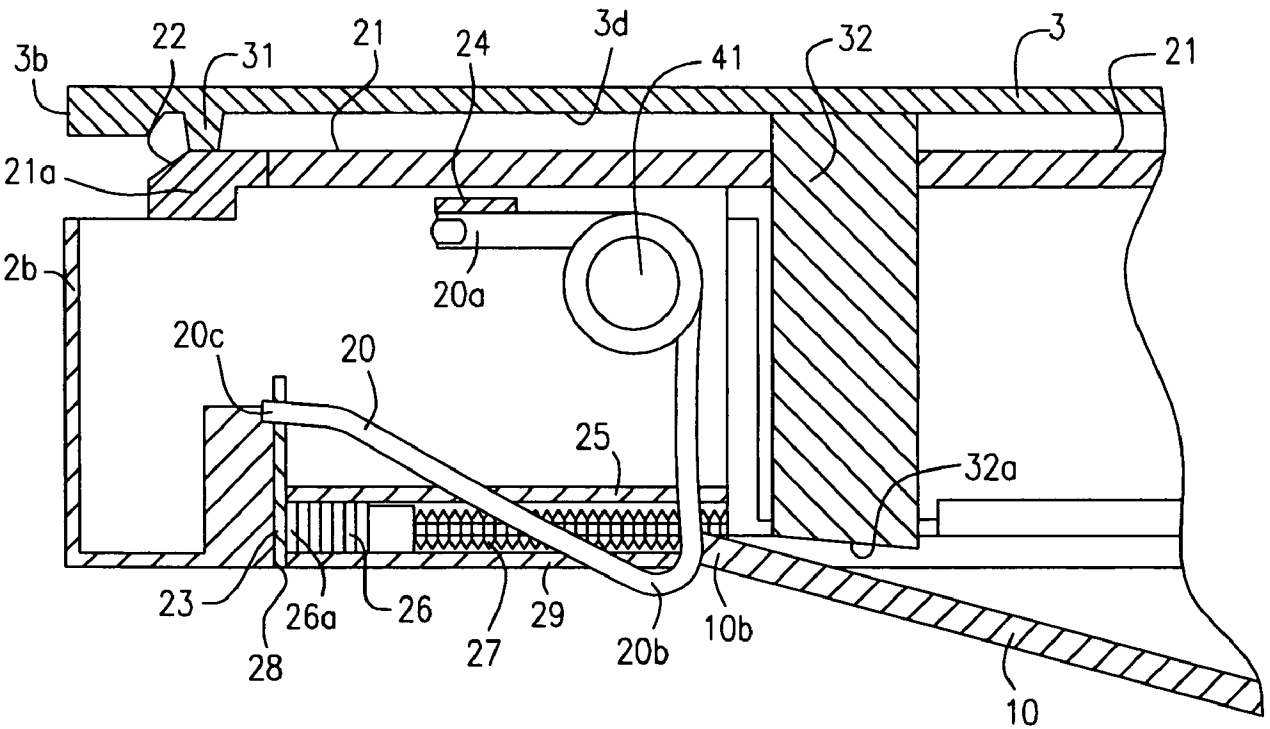
FIGS. 3*a* and 3*b* illustrate, in a larger scale, the operational components shown in FIG. 1 when the striking plate is at its initial position and fire position, respectively.
Figure 3B:
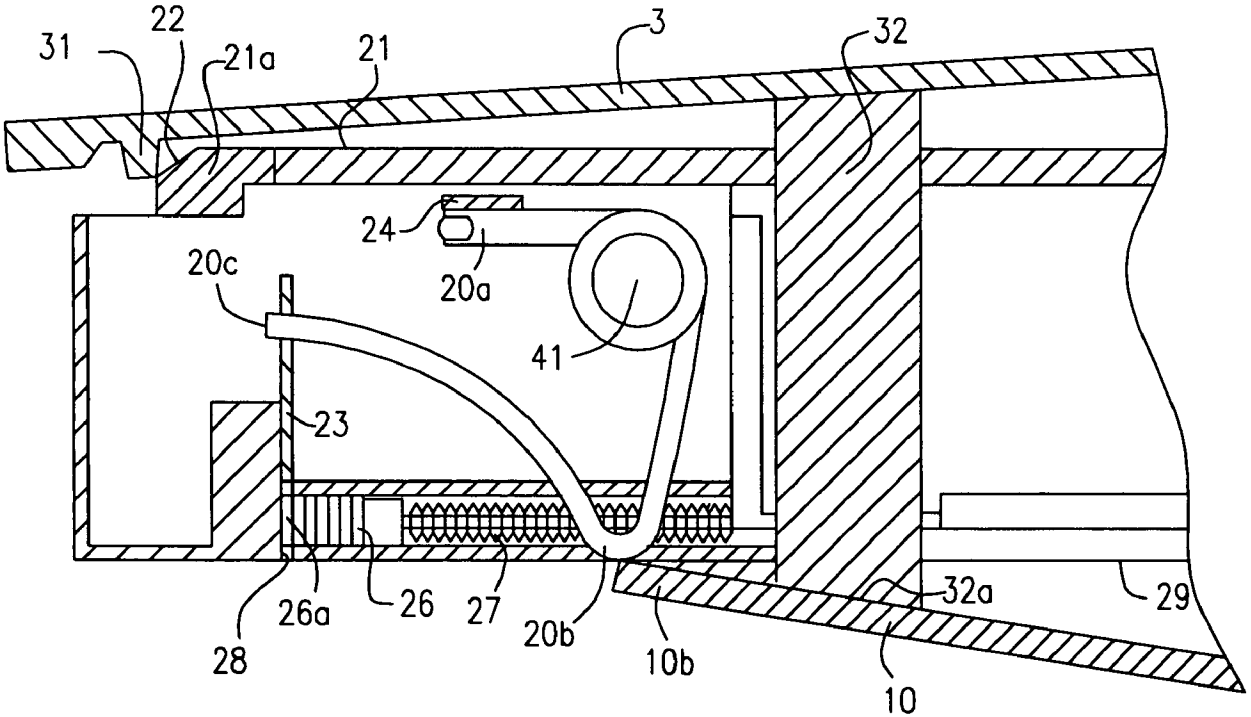

As shown in FIG. 3*a*, before a stapling operation, the striking plate 23 stays in its initial position and fills in the dispensing gap 28. The staple stick 26 is biased toward the striking plate 23 by a biasing spring 27, with a leading staple 26*a* being pressed against the striking plate 23. At this time, a release bar 32 extending from the cover plate 3 does not touch the triggering lever 10.

During a stapling operation, a pressure is applied on the cover plate 3 to move the body 2 toward the base 1. The upper end 10*b* of the triggering lever 10, which engages with the engagement portion 20*b* of the striker spring 20, slides forward along the under surface 29 and pushes the striker spring 20 to deform and rotate clockwise around the lateral shaft 41. The free end 20*c* is forced to move upward, thereby lifting the striking plate 23 to the fire position as shown in FIG. 3*b*. At the same time, energy is stored in the deformed striker spring 20. Under biasing force of the spring 27, the staple stick 26 is pushed forward and the leading staple 26*a* enters the dispensing gap 28 left by the lifted striking plate 23.

When the striking plate 23 reaches the fire position as shown in FIG. 3*b*, the upper end 10*b* still engages with the engagement position 20*b*. However, at this point, the release bar 32 has reached the triggering lever 10, because 31 has now slid down slope 22, as explained later in more detail, permitting the release bar 32 to move downwardly. Thus, upon further pressing the cover plate 3, the release bar 32 will press the triggering lever 10 downwardly to leave and disengage from the engagement portion 20*b* of the striker spring 20, whereby the striker spring 20 is released to resume its initial shape. Thus, with the energy released from the striker spring 20, the striker spring 20 powerfully drives the striking plate 23 back to its initial position as shown in FIG. 3*a*, and the striking plate 23 in turn strikes the leading staple 26*a* in the dispensing gap 28 into the work piece 40. With the appropriately shaped stapling recesses 11*a* provided on the upper surface 11, the leading staple 26*a* is bent and stapled to the work piece 40 in a conventional way. The striking plate 23 resumes its initial position and fills in the dispensing gap 28 as shown in FIG. 3*a*, ready for next stapling operation.

To facilitate returning of the triggering lever 10 after the striking spring 20 resumes its initial shape, the engagement portion 20*b* of the striker spring 20 preferably has a generally round forward portion so that the upper end 10*b* of the triggering lever 10 can easily slide over the engagement portion 20*b* back to its initial position. However, the backward portion is preferably flat or slightly concave for providing solid engagement with the upper end 10*b* of the triggering lever 10 before the striking plate reaches the fire position.

Preferably, the release bar 32 has an inclined lower edge 32*a* so as to provide a better contact with the triggering lever 10.

As mentioned above, before the stapling operation, the release bar 32 does not touch the triggering lever 20, as shown in FIG. 3*a*. This is realized by a gap provided between the under surface 3*d* of the cover plate 3 and the upper surface 21 of the body 2. More specifically, a stop 31 is provided depending from the under surface 3*d* of the cover plate 3 near the front end 3*b* and rests on an edge portion 21*a* of the top surface 21 near the front end 2*b*. Preferably, the edge portion 21*b* is formed with a forwardly inclined slope 22. The edge portion 21*b* may be made of a different material from that of the upper surface 21 (as shown), or may simply be a portion of the upper surface.

During the stapling operation, the cover plate 3 moves relative to the body 2, and the stop 31 will leave the edge portion 21*a*, thus decreasing the gap between the under surface 3*d* of the cover plate 3 and the upper surface 21 of the body 2, whereby moving the release bar 32 downwardly relative to the body 2 so as to press on the triggering lever 10. The relative movement between the cover plate 3 and the body 2 will be explained with more detail below.

Figure 4:
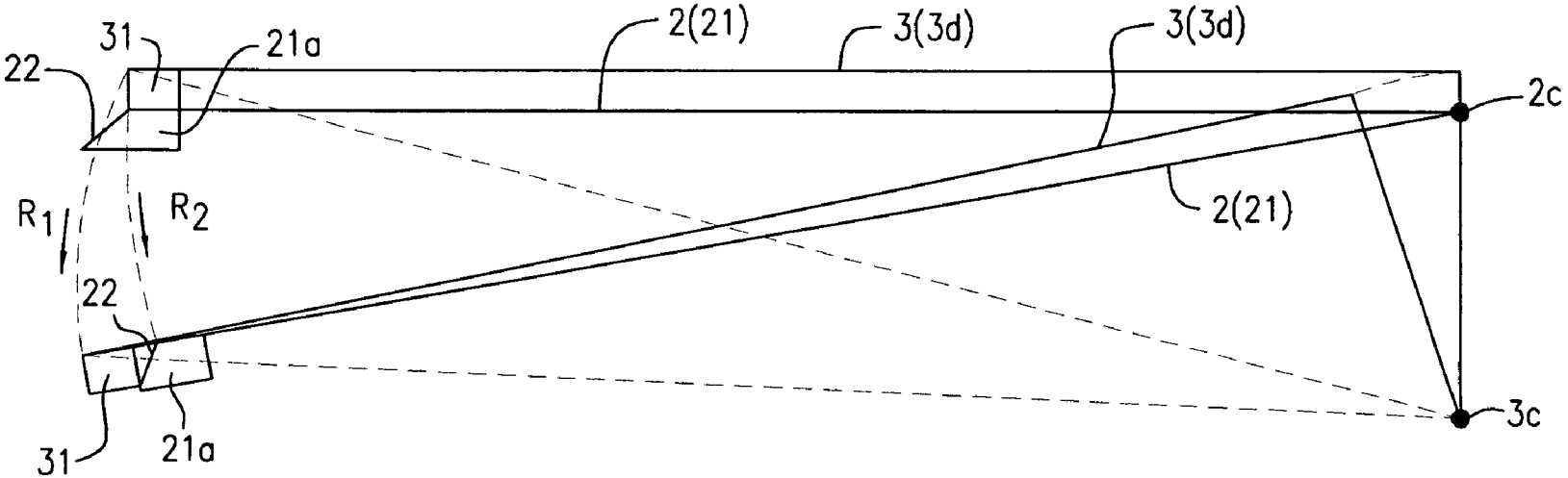
FIG. 4 illustrates the relative movements between the cover plate and the body.
Figure 5:
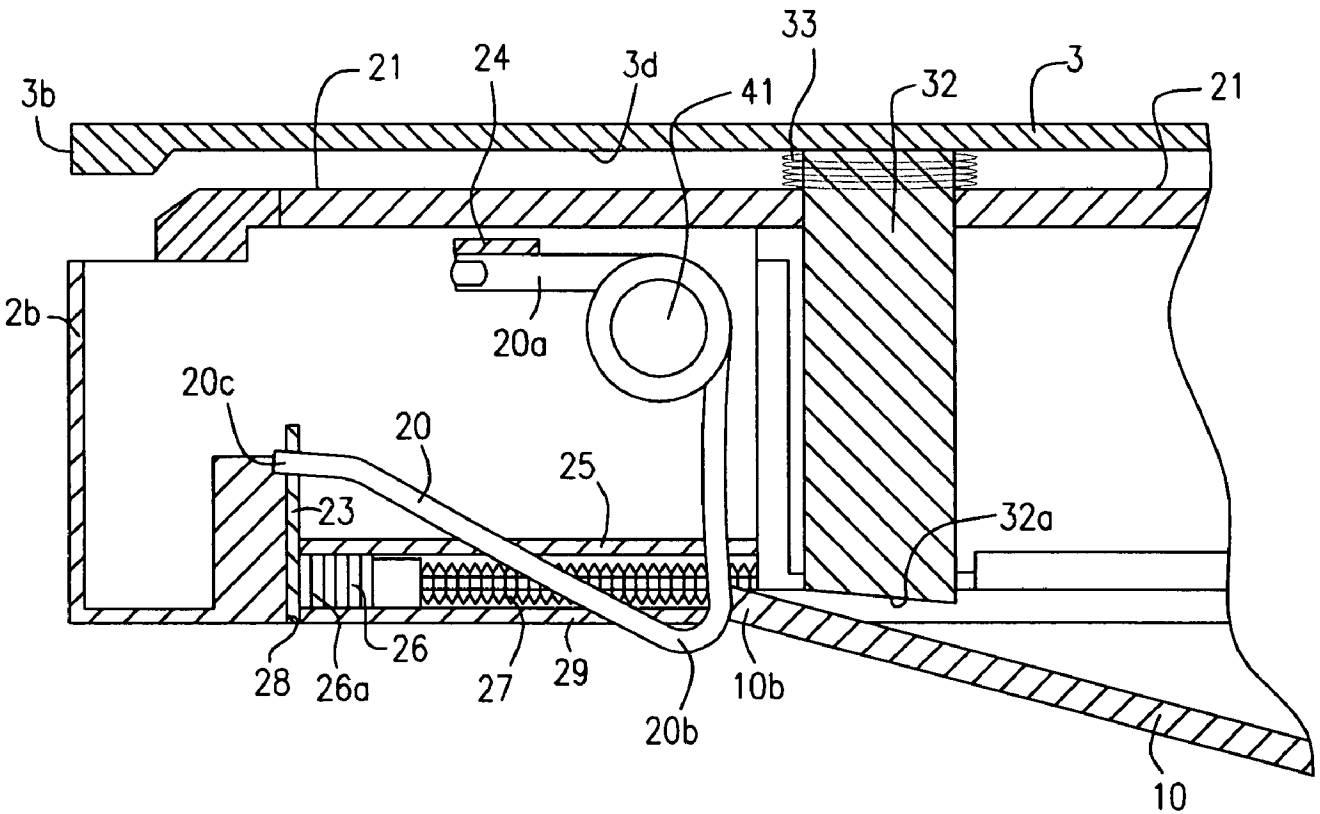
FIG. 5 illustrates a stapler of a second embodiment according to the present invention.

As shown in FIGS. 2 and 4, the cover plate 3 is pivotably connected to the bracket plates 4 (which are fixed to the base 1) at a pivotal point 3*c*, while the body 2 is pivotably connected to the bracket plate 4 at a pivotal point 2*c*. As shown in FIG. 5, when both the cover plate 3 and the body 2 are rotated around respective pivotal points 3*c* and 2*c*, the rotational radius R1 of the stop 31 is larger than the rotational radius R2 of the edge portion 21*a*. Thus, when the cover plate 3 and the body 2 rotate together, the stop 31 will gradually slide along the slope 22 and finally leave the edge portion 21*a*, which decreases the gap between the under surface 3*d* of the cover plate 3 and the upper surface 21 of the body 2.

FIG. 5 shows a second embodiment which is similar to that shown in FIGS. 3*a* and 3*b*. In this embodiment, the cover plate 3 is spaced from the upper surface 21 by a compressed spring 33. Before the striking plate 23 reaches its fire position (such as shown in FIG. 3*b*) during a stapling operation, the compressed spring 33 is strong enough to prevent the cover plate 3 to move closer to the body 2. When the striking plate 23 reaches its fire position, the triggering lever 10 still engages with the engagement portion 20*b* of the striker spring 20, and the body 2 continues to move downward until it rests on the work piece 40. Then, further applying pressure on the cover plate 3 will overcome the force of the compressed spring 33 and move the cover plate 3 downwardly relative to the body 2, whereby the release bar 32 presses on the triggering lever 10 to release the triggering lever 10 from engagement with the engagement portion 20*b* of the striker spring 20. Conceivably, in this embodiment, the pivotal points 2*c*, 3*c* of the cover plate 3 and the body 2 (FIG. 2) can be the same or close to each other.

Figure 6A:
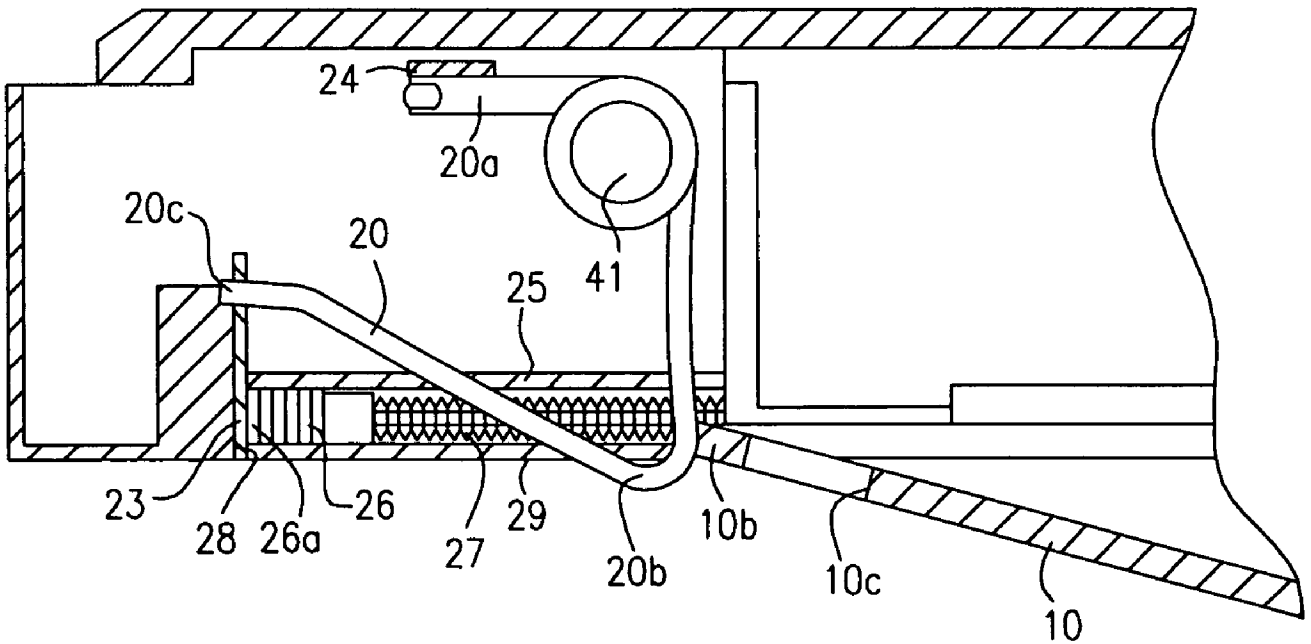
FIGS. 6*a*, 6*b* and 6*c* illustrate a stapler of a third embodiment according to the present invention.
Figure 6B:
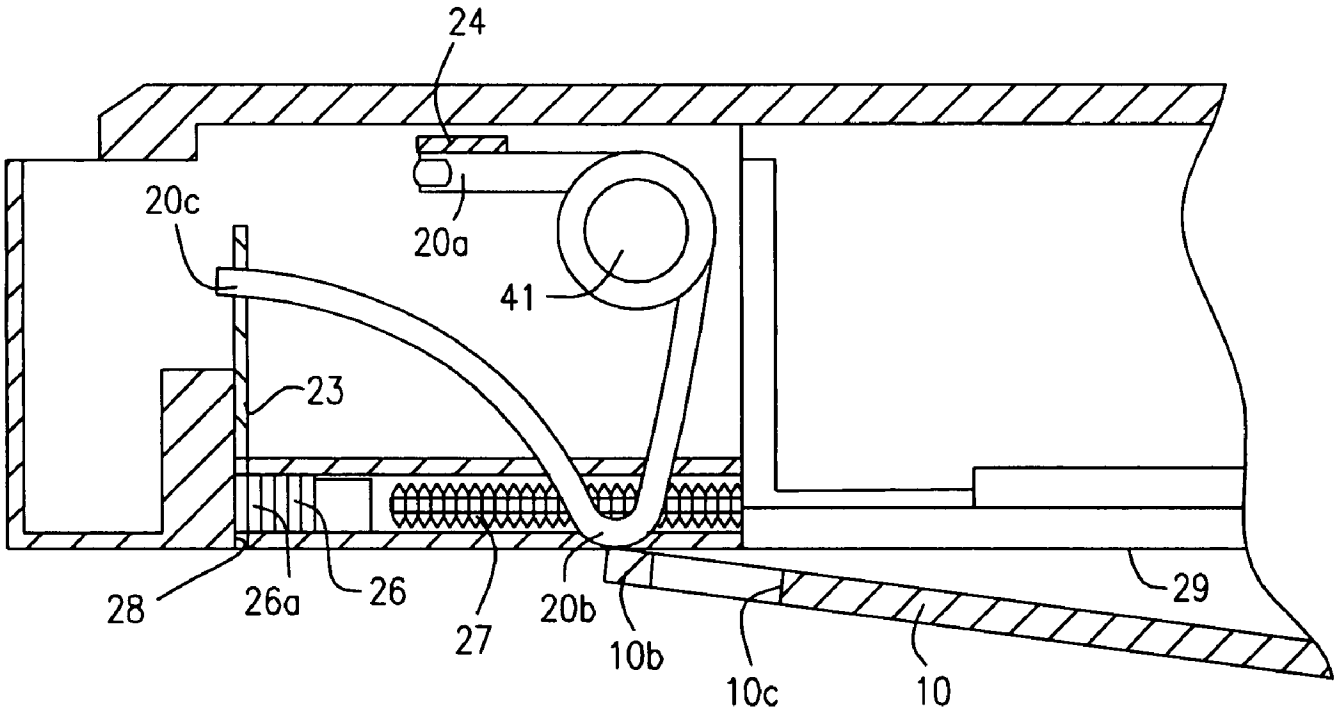
Figure 6C:
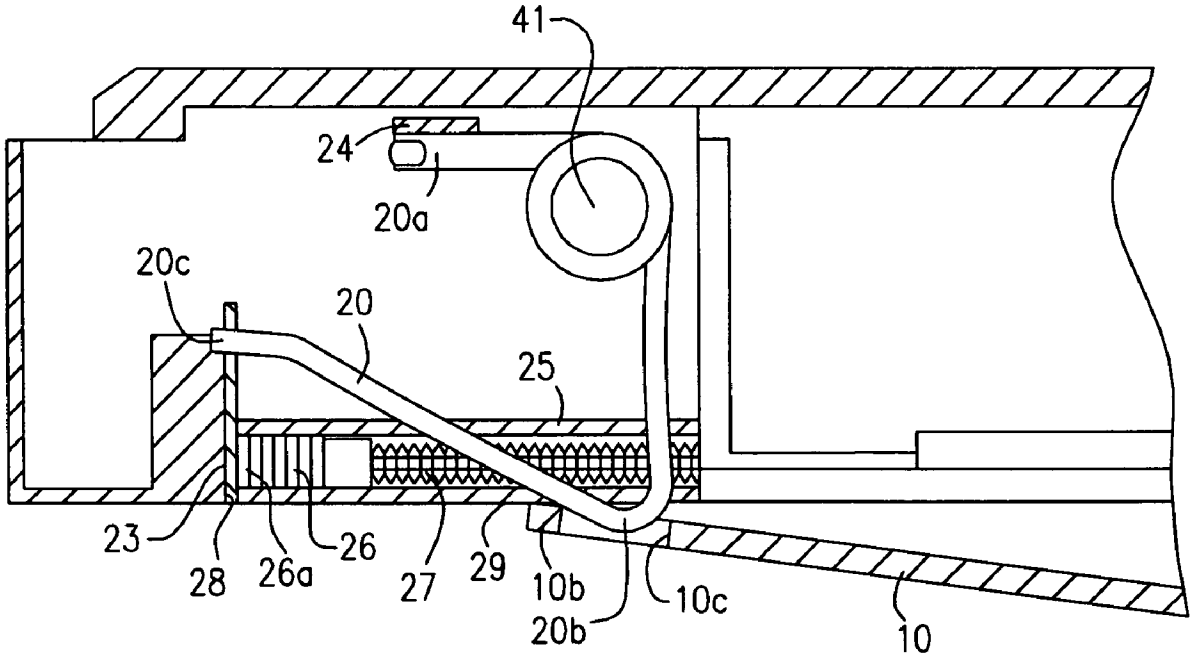

FIGS. 6*a*, 6*b* and 6*c* illustrate a third embodiment similar to FIGS. 1–5. In this embodiment, the triggering lever 10 is formed with a square opening 10*c* near the upper end 10*b*. FIG. 6*a* shows the status before a stapling operation. FIG. 6*b* shows that the striking plate 23 reaches the fire position during a stapling operation, in which the engagement portion 20*b* of the striker spring 20 reaches the edge of the opening 10*c* of the triggering lever 10. Upon further pressing the body 2 toward the base 1, the engagement portion 20*b* of the striker spring 20 will snap back into the opening 10*c* of the triggering lever 10 as shown in FIG. 6*c*, thereby releasing the force that the triggering lever 10 has applied on the striker spring 20. The striking spring 20 resumes its initial shape and actuates the striking plate 23 to dispense the staple 26*b*, with the engagement portion 20 staying inside the opening 10*c*. After the stapling operation, the user may lift the body 2 from the base 1 to help removing the engagement portion 20*b* of the striker spring 2 from the opening 10*c*, thus the triggering lever 10 can return to its initial position. In this embodiment, the cover plate 3 and the release bar 32 are not needed, and the force can be applied directly to the upper surface 21 of the body 2 for the stapling operation.

Figure 7:
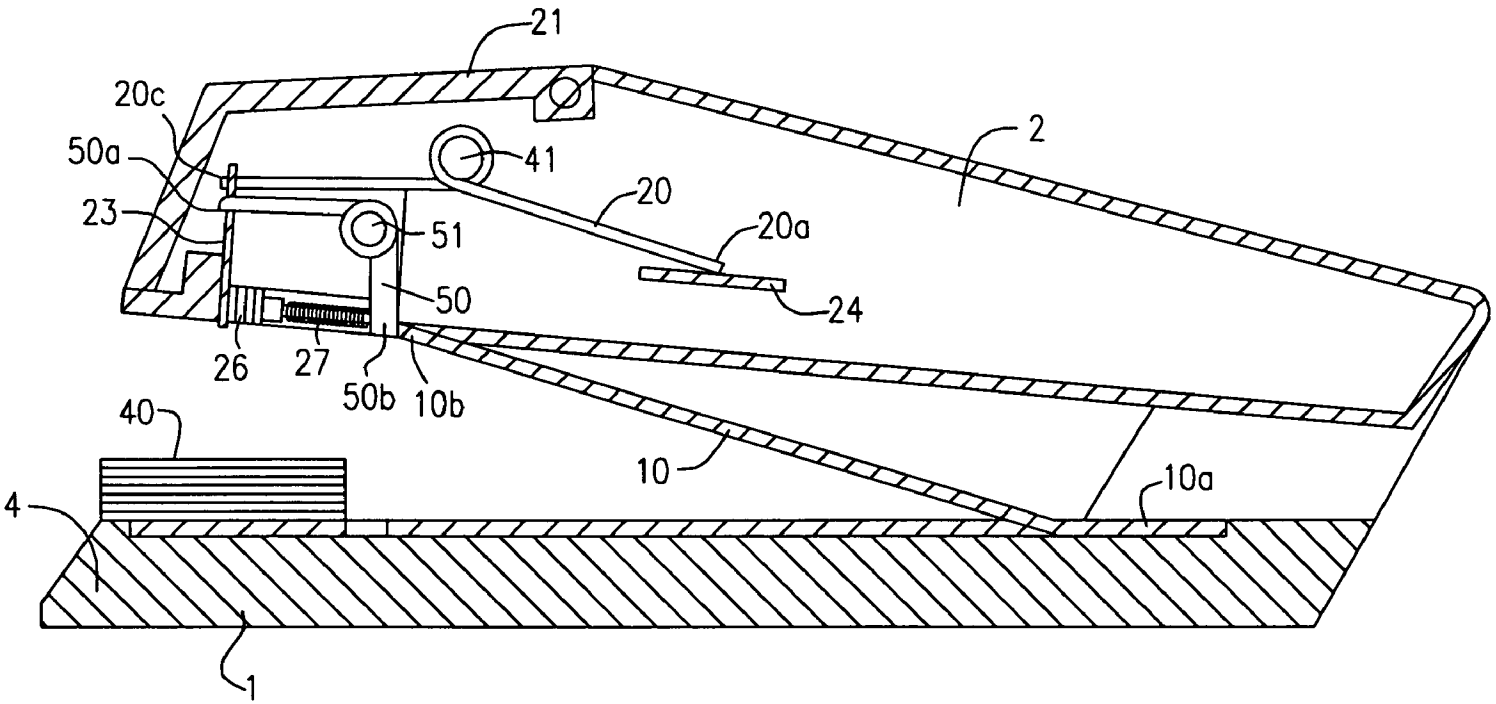
FIG. 7 illustrates a stapler of a fourth embodiment according to the present invention.

FIG. 7 illustrates a fourth embodiment according to the present invention. Unlike the previous embodiments in which the triggering lever 10 moves the striking plate 23 through the striker spring 20, in this embodiment, the triggering lever 10 does not directly engage with the striker spring 10, but instead actuates the striking plate 23 by means of an L-shaped transmission element 50 rotatably mounted on a lateral shaft 51. The upper end 10*b* of the triggering lever 20 abuts against the lower end 50*b* of the transmission element 50, while the upper end 50*a* of the transmission element 50 engages with a hole in the striking plate 23. With a proper return spring mechanism (not shown), the transmission element 50 is biased to the position as shown in FIG. 7, where the striking plate 23 rests at its initial position and the upper end 50*a* engages with the hole in the striking plate 23.

Similar to the previous embodiments, the striker spring 20 is mounted on a lateral shaft 41. One end 20*a* of the striker spring 20 is retained by a stop plate 24, while the other end 20*c* engages with an aperture formed on the striking plate 23.

Figure 8A:
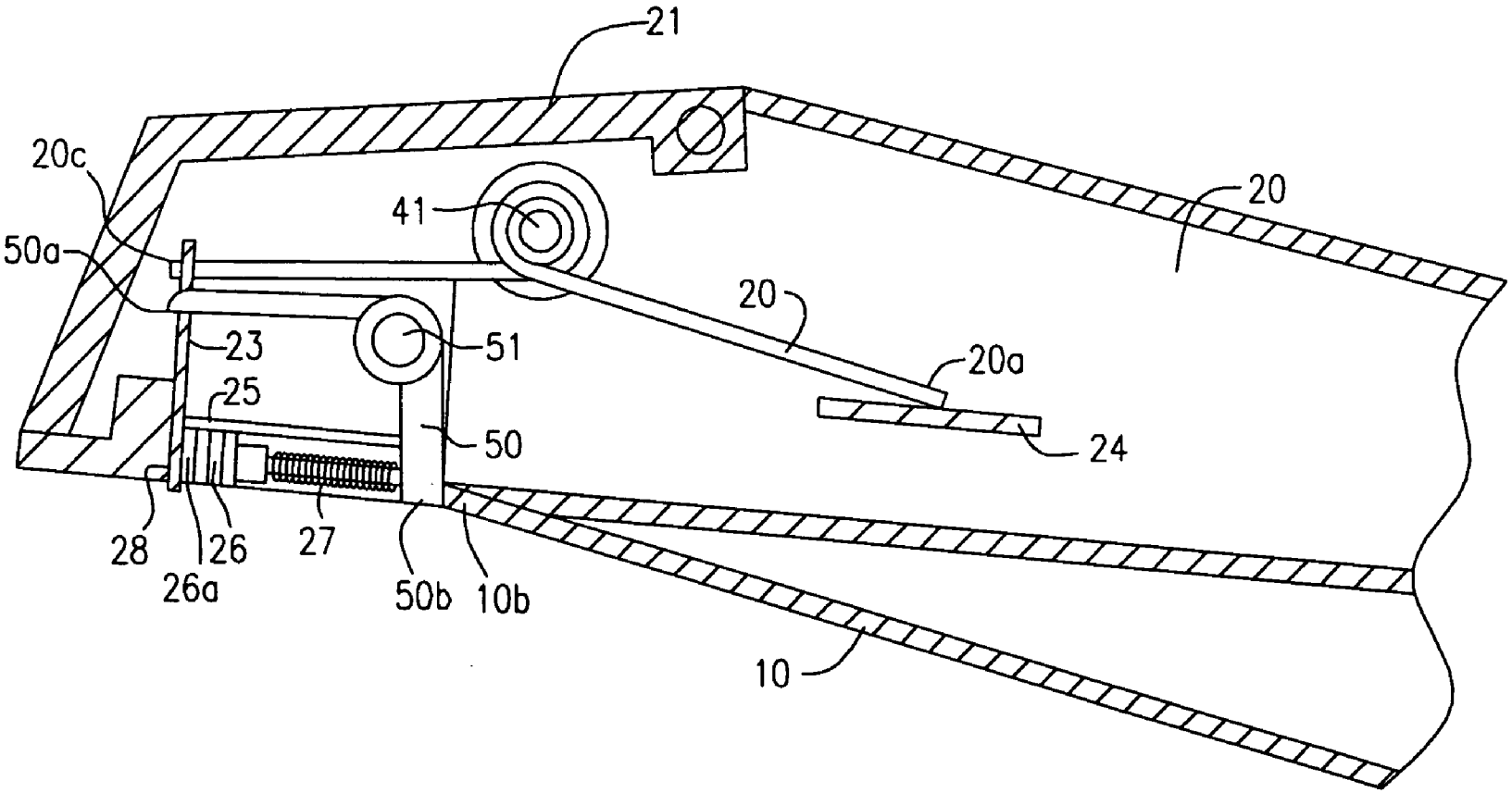
FIGS. 8*a* and 8*b* illustrate the operational components in FIG. 7 when the striking plate is at its initial position and fire position, respectively.

Before the stapling operation, as shown in FIG. 8*a*, the striking plate 23 stays in the initial position and fills in the dispensing gap 28. The staple stick 26 in the staple magazine 25 is biased forward by the spring 27, with a leading staple 26*a* pressed against the striking plate 23.

Similar to the previous embodiments, the triggering lever 10 is preferably made of a resilient material and servers as a raiser element to keep the body 2 and the base 1 away from each other by a proper distance for accepting a work piece 40. Before the stapling operation, the upper end 10*b* abuts the lower end 50*b* of the transmission element 50, while the upper end 50*a* of the transmission element 50 engages with the hole on the striking plate 23 under the biasing force of the return spring mechanism (not shown).

Figure 8B:
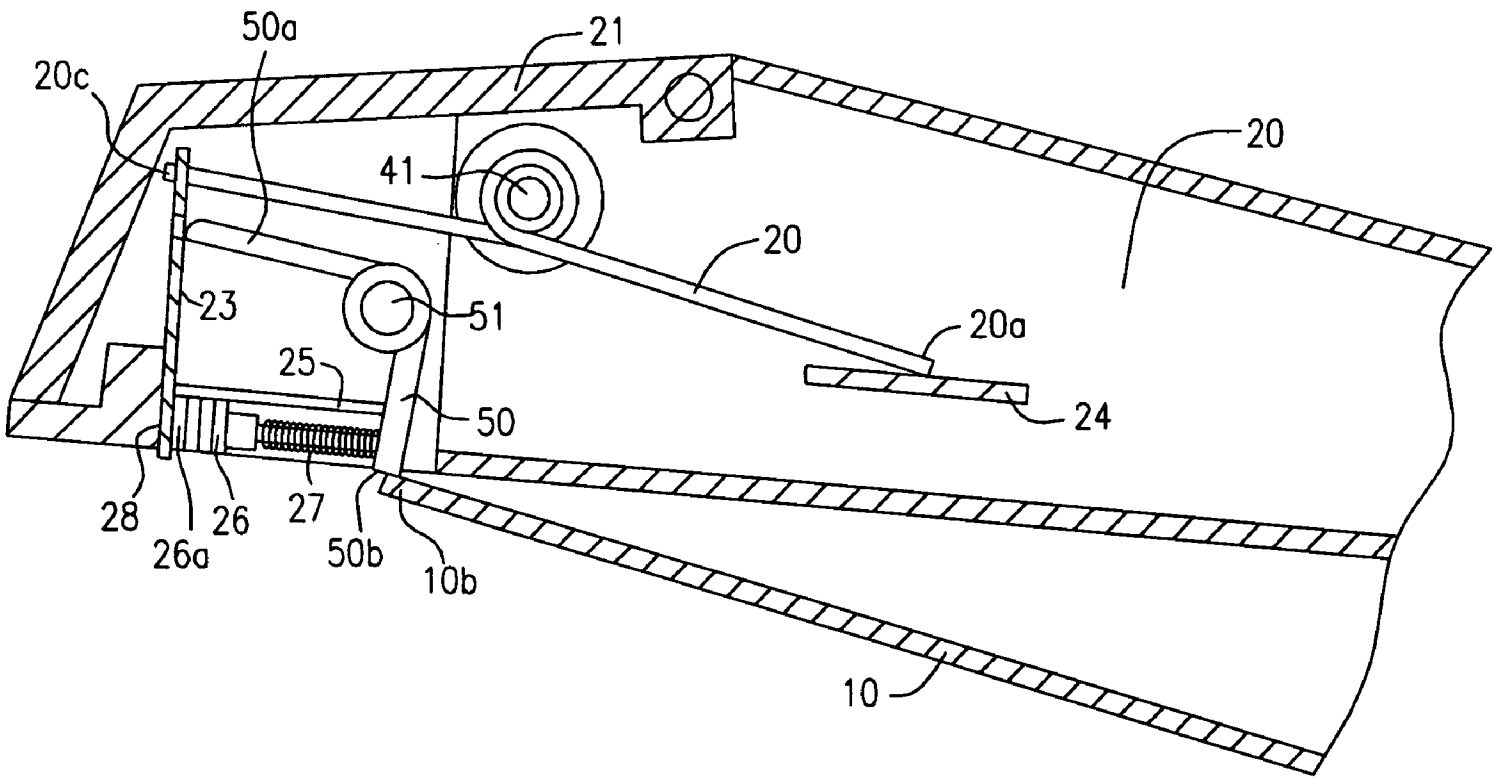

During a stapling operation, a pressure is applied on the cover or upper surface 21 of the body 2 so as to move the body 2 toward the base 1. The upper end 10*b* of the triggering lever 10 moves forward and forces the L-shaped transmission element 50 to rotate clockwise around the shaft 51, whereby the upper end 50*a* moves upward against the force of the return spring mechanism as well as the force of the spring 20, and lifts the striking plate 23 to the fire position as shown in FIG. 8*b*. At the fire position shown in FIG. 8*b*, the striking plate 23 leaves the dispensing gap 28, and the leading staple 26*a* is forced by the spring 27 to enter the dispensing gap 28. The up-going striking plate 23 forces the end 20*c* of the striker spring 20 to move upward and deforms and energizes the striker spring 20. In the fire position shown in FIG. 8*b*, the upper end 50*a* of the transmission element 50 is ready to disengage from the hole of the striking plate 23. Thus, further pressing on the body 2 will further rotate the transmission element 50 to release the upper end 50*a* from the hole of the striking plate 23. Without the upward force applied by the transmission element 50 on the striking plate 23, the deformed striker spring 20 powerfully drives the striking plate 23 downward back to its initial position as shown in FIG. 8*a* to dispense the leading staple 26*a* in the dispending gap 28 to the work piece 40.

After the striking plate 23 resumes its initial position, the force applied on the cover or upper surface 21 of the body 2 may be removed. The resilient triggering lever 10 moves back to its initial position, releasing its engagement with the lower end 50*b* of the transmission element 50. The transmission element 50 returns to its initial position as shown in FIG. 8*a* under the biasing force of the return spring mechanism (not shown), and the upper end 50*a* re-engages with the hole of the striking plate. All the components are now ready for next stapling operation again.

Although the above has described several preferred embodiments, it is appreciated that numerous adaptations, changes, variations and modifications are possible to a person skilled in the art without departing the gist of the present invention. For example, the striker spring 20 can be advantageously constructed with dual legs for higher strength. Alternatively, the striker spring 20 can be a leaf spring. Moreover, the triggering lever 10 may be arranged inside the body 2, such as between the cover plate 3 and the body 2, and not connected to the base 1. Therefore, the scope of the present invention is solely intended to be defined by the accompanying claims.

What is claimed is:

1. A stapling apparatus, comprising:

a base member having a first end and a second end;

a magazine member for accommodating a set of staples therein, said magazine member having a first end and a second end and is pivotably connected with said base member at said first ends of said two members;

a striking plate for individually dispensing said staples upon actuation by a striker spring; and a triggering mechanism for triggering said actuation of said striker spring;

wherein said triggering mechanism comprises a triggering lever arranged such that said triggering lever triggers said actuation of said striker spring when said seconds ends of said two members are moved towards each other.

2. The stapling apparatus of claim 1, wherein said triggering lever has a lower end secured to an upper surface of said base member.

3. The stapling apparatus of claim 2, wherein said triggering lever has an upper end freely abutting against a bottom surface of said staple magazine.

4. The stapling apparatus of claim 3, wherein said triggering lever is made of a resilient material and normally biases said second ends of said base member and said magazine member away from each other by a distance for accepting a work piece.

5. The stapling apparatus of claim 4, wherein said striker spring has a first end portion engaged with a hole formed on said striking plate for moving said striking plate between a first position and a second position.

6. The stapling apparatus of claim 5, wherein said triggering lever is arranged such that, when said magazine member and said base member are moved toward each other, said upper end of said lever engages with said striker spring to force said striker spring to deform whereby said striker spring brings said striking plate from said first position to said second position.

7. The stapling apparatus of claim 6, further comprising a release mechanism for releasing said engagement between said trigger lever and said striker spring when said striking plate reaches said second position whereby said striker spring resumes its initial form and drives said striking plate back to said first position for dispensing a leading one of said staples.

8. The stapling apparatus of claim 7, wherein said release mechanism comprises a release bar for pushing push said trigger lever downwardly when said striking plate reaches said second position, so as to disengage said trigger lever from said striker spring.

9. The stapling apparatus of claim 8, wherein said release mechanism further comprises a cover member provided above said magazine member, and said release bar depends from an undersurface of said cover member.

10. The stapling apparatus of claim 9, wherein said cover member comprises a first end pivotably connected to said first end of said base member and a free second end.

11. The stapling apparatus of claim 10, wherein said cover member is spaced from an upper surface of said magazine member, whereby preventing said release bar from reaching said trigger lever before said striking plate reaches said second position.

12. The stapling apparatus of claim 11, wherein said cover member and said magazine member are spaced by means of a stop, which is formed on said undersurface of said cover member near said second end thereof, and rests on an edge portion formed on said upper surface of said magazine member at said first end thereof.

13. The stapling apparatus of claim 12, wherein said cover member and said magazine member are pivotably connected with said first end of said base member in a way that said stop moves beyond said edge portion when said cover member and said magazine members are moved together toward said base member during a stapling operation, whereby said space between said cover member and said magazine member is diminished, and said release bar presses on said trigger lever.

14. The stapling apparatus of claim 13, wherein said edge portion on said upper surface of said magazine member terminates with a slope inclined forwardly.

15. The stapling apparatus of claim 14, wherein said stop is adapted to slide along said slope so as to gradually diminish said space between said cover member and said magazine member when said cover member and said magazine members are moved together toward said base member during a stapling operation.

16. A stapling apparatus, comprising:

a base and a staple magazine for accommodating a set of staples therein, said base and said magazine each having a first end and second end, and being pivotably connected to each other at first ends and normally biased away from each other by a distance at second ends;

a striking plate for individually dispensing said staples upon actuation by a striker spring, said striking plate being reciprocally movable between a first position and a second position; and a triggering lever arranged such that when said second ends of said base and said magazine are forced to move toward to each other, said triggering lever forces said striking plate to move from said first position to said second position and forces said spring to deform, and when said striking plate reaches said second position, said triggering lever releases said striking plate to be driven by said striking plate back to said first position for dispensing a leading one of said staples.

17. The stapling apparatus of claim 16, wherein said triggering lever is made of a resilient material having a lower end secured on said base and a free upper end abutting against said magazine whereby normally keeping a distance between said base and said magazine.

18. The stapling apparatus of claim 17, wherein said triggering level extends from said base to said magazine in an direction toward said second ends, whereby said upper end is adapted to move in a direction toward said second end relative to an undersurface of said magazine when said magazine and said base are toward to each other during a stapling operation.

19. A stapling apparatus of claim 18, wherein said triggering lever cooperates with a transmission mechanism to force said striking pate to move from said first position to said second position.

20. The stapling apparatus of claim 19, wherein said transmission mechanism comprises an driving shaft for engaging with a hole provided on said striking plate.

21. A stapler comprising:

a base portion;

a body portion having a housing for accommodating a staple stick therein;

a plunger, actuated by a striker spring, for dispensing a leading staple of said staple stick to a work piece placed between said base portion and said body portion; and a trigger for forcing said striker spring to deform when said base portion and said body portion are squeezed toward each other until a point where said striker spring is released to resume its initial form, thereby actuating said plunger to dispense said leading staple.

22. The stapler of claim 21, wherein said trigger is a resilient lever having a first end secured to said base and a second end freely abutting against an undersurface of said body portion, whereby normally biasing said base portion and said body portion away from each other by a distance.

23. The stapler of claim 21, wherein said trigger engages with said striker spring and drives said plunger from an initial position to a release position through said striker spring.

24. The stapler of claim 21, wherein said trigger engages with said plunger and forces said striker spring to deform through driving said plunger to move from an initial position to a release position.

* * * * *